United States Patent [19]

Shingu et al.

[11] Patent Number: 4,820,141

[45] Date of Patent: Apr. 11, 1989

[54] METHOD FOR THE MANUFACTURE OF FORMED PRODUCTS FROM POWDERS, FOILS, OR FINE WIRES

[75] Inventors: Hideo Shingu, Kyoto; Mitsunobu Abe, Kawasaki; Takashi Sato, Kawasaki; Toshio Yamada, Kawasaki, all of Japan

[73] Assignee: Nippon Steel Corporation, Tokyo, Japan

[21] Appl. No.: 131,715

[22] Filed: Dec. 11, 1987

[30] Foreign Application Priority Data

| | | | |
|---|---|---|---|
| Dec. 12, 1986 | [JP] | Japan | 61-294664 |
| Mar. 31, 1987 | [JP] | Japan | 62-76042 |
| Mar. 31, 1987 | [JP] | Japan | 62-76043 |

[51] Int. Cl.[4] ..... G22F 7/00

[52] U.S. Cl. ..... 419/8; 419/4; 419/25; 419/43; 419/50; 419/69; 264/512; 264/564

[58] Field of Search ..... 419/69, 50, 43, 25, 419/4, 8; 264/532, 564

[56] References Cited

U.S. PATENT DOCUMENTS

| | | | |
|---|---|---|---|
| 3,474,518 | 10/1969 | Strandell | 419/50 |
| 3,481,013 | 12/1969 | Dannohl | 419/50 |
| 3,866,303 | 2/1975 | Chehi | 419/50 |
| 4,588,552 | 5/1986 | Schroder et al. | 419/50 |

FOREIGN PATENT DOCUMENTS

| | | |
|---|---|---|
| 55-1323 | 1/1980 | Japan . |
| 56-45289 | 4/1981 | Japan . |
| 5141521 | 9/1982 | Japan . |
| 60-58289 | 12/1985 | Japan . |

OTHER PUBLICATIONS

"The Condensed Chemical Dictionary", Eighth Edition (1971), pp. 788–789.

*Primary Examiner*—Stephen J. Lechert, Jr.
*Attorney, Agent, or Firm*—Wenderoth, Lind & Ponack

[57] ABSTRACT

A method for forming non-equilibrium and/or metastable metallic or non-metallic powder, foil or fine wire material into a solid body comprises charging the material into a metal container, subjecting the metal container containing the material to rolling at a temperature at which the inherent properties of the material are maintained, and thereafter removing the metal container.

7 Claims, 2 Drawing Sheets

METHOD FOR THE MANUFACTURE OF FORMED PRODUCTS FROM POWDERS, FOILS, OR FINE WIRES

BACKGROUND OF THE INVENTION

1. Field of the Invention

The present invention relates to a method for the manufacture of formed products, of plate-like or three-dimensional shapes which possesses a density at or near the theoretical value and have a desired thickness and more particularly to a method for the manufacture of such formed products from non-equilibrium and/or metastable metallic or non-metallic powders, foils, or fine wires, for example, produced by rapid quenching or mechanical alloying method.

2. Description of the Prior Art

Non-equilibrium and/or metastable materials possess superior physical and chemical properties. However, since they are produced by forced cooling techniques, they are in the form of powders, foils or fine wires, and are thus restricted as regards fields of utilization.

In the conventional powder rolling process it is hard to obtain effective biting of the powder by the rolling rolls because the powder is under no restriction whatsoever during the feeding thereof. Accordingly, it is not possible to produce a thick formed product and uniform rolling is also difficult. In addition, a low green density is unavoidable because heavy rolling reduction is impossible.

Various methods for rolling a container filled with powder have been disclosed as follows: Japanese published examined patent application Nos. Sho-55-1323, Sho-57-41521 and Sho-60-58289 and published unexamined patent application No. Sho-56-45289. These relate to methods wherein a powder is charged into a metal container, is optionally powder sintered, the container and powder are then heated to a high temperature at which the powder is easily sintered and the resistance of the container to deformation is small, and the container and the powder are then subjected to hot rolling to obtain a formed product.

These methods are advantageous in that the container need not have high strength and that a formed product can be obtained efficiently.

However, these known methods which involve heating of the powder to a high temperature are not appropriate for manufacturing solid shaped products from non-equilibrium and/or metastable materials because the excellent physical and chemical properties of these materials are lost by heating to a high temperature.

SUMMARY OF THE INVENTION

It is a prime object of the invention to provide a method for the manufacture of a solid formed product having the same excellent physical and chemical properties as the starting materials from powder, foil, or fine wire materials having superior properties attributable to their microstructures.

It is another object of the invention to provide a method for forming a solid shaped product from an amorphous powder material with no loss of the excellent properties thereof.

DETAILED DESCRIPTION OF THE INVENTION

The present invention relates to a method for the manufacture of a plate-like solid formed product having a desired thickness (hereafter a "solid formed product"), from powder, foil, or fine wire material with no loss of the physical and chemical properties thereof.

In the present invention, the powder material may be any of various metal or non-metal powders of various finenesses. For instance, rapidly quenched powders produced by the water atomizing method have superior physical properties ascribable to their microstructure, while super-fine powders also have excellent properties ascribable to their extreme fineness.

The "foils" used in this invention are coil-like or multilayered and are bundled together into sizes large enough for formation of a solid shaped product by rolling.

The "fine wires" used in this invention are whiskers having superior properties ascribable to their microstructure like the amorphous wire produced by water quenching method. They are bundled together into sizes large enough for formation of a solid shaped product by rolling.

Figure 1:
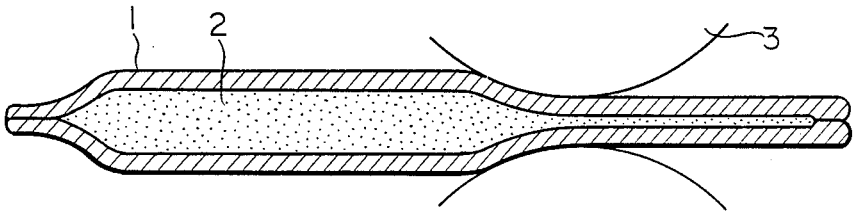
FIG. 1 is a sectional view showing a rolling step according to the present invention for a metal pipe containing amorphous material therein.

FIG. 1 shows a rolling step in accordance with the invention for a metal container containing a powder, foil, or fine wire material. The powder, foil, or fine wire material 2 is charged into a metal container 1, which is a tube or the like with sufficient wall thickness and strength. The metal container with the fine material therein is subjected to rolling by the rolls 3.

At this time, the rolling pressure plastically deforms the metal container and the fine material therein. The resistance of the metal container to deformation is greater than that of the material therein. The metal container has high strength and good ductility. Therefore the rolling process requires great rolling reduction pressure, which results in densification of the material.

The material is confined within the metal container and is thus forced between the rolls. While entry of the material between the rolls causes a force tending to push the material backward, the metal container is designed to have sufficient strength to resist deformation by this force.

Poor biting of the material by the rolls due to its fluidity can be prevented by sealing the end of the container.

The rolling process is carried out at a "property preserving temperature" which is lower than the usual sintering and hot rolling temperature. This is necessary because the heating of, for instance, a material which is very fine up to the sintering and hot rolling temperature causes the super fine powder particles to cohere and grow into large particles with a resulting loss of the inherent superior properties of the material.

The property-preservation temperature depends on the material. For example, in the case of amorphous 2826MB foil, it is less than the crystallization temperature of about 410° C., and in the case of a rapidly quenched powder of 90 weight % Al and 10 weight % Fe, it is less than about 350° C. If the powder material is subjected to the forming step at a temperature lower than the pertinent specified temperature, a formed product is obtained with no loss of the superior physical and chemical properties of the amorphous or rapidly quenched material. It should be noted, however, that in the rolling step if the material is held at near the upper limit of the property-preservation temperature for a long time, loss of the superior properties may occur.

Accordingly, as the heating means it is preferable to use one such as a hot bath which enable rapid heating. Further, after the rolling step, for the same reason, the immersion of the material in a cooling bath is preferable.

In the present invention, the hot bath or cooling bath can be freely applied since the material is wholly covered by the metal container. It is thus possible to manufacture a solid formed product without any loss of the inherent superior properties of the material.

In the present invention, a forced-bite rolling is applied. Therefore shear deformation (relative slip) arises between the powder particles, foils or fine wires. Such shear deformation does not happen in the conventional powder forming process (e.g. Hot Isostatic Pressing or Cold Isostatic Pressing, etc.) using hydrostatic pressure. And since both the material and the metal container of high strength are subjected to the rolling step, the material is also subjected to a great rolling reduction, whereby great deformation occurs among the powder particles or the like.

As a result, from the point of forced adhesion of the powder particles, it is possible to obtain a very excellent formed body. This means that the method of this invention enables a formed body with a density at or near the theoretical value to be obtained at a temperature much lower than that of the prior art sintering and hot rolling process.

Accordingly, as it enables production of a formed body of high density, the method of the present invention can very advantageously be applied for the manufacture of formed bodies from super rapidly cooled powders and amorphous foils or powders without any degradation of the inherent superior properties of these materials.

In this invention, depending on the kind of material, rolling of the material in the container can be carried out after the container has been evacuated. Further, a metal container provided with a gas vent and sealed with an inert gas therein may also be used in the rolling step.

In accordance with this invention, the metal container filled with the material may be heated or cooled repeatedly to a desired temperature in the specified property-preserving temperature range in the course of the rolling process.

Moreover, the formed body of high density obtained by the method of this invention may, together with the metal container, be continuously subjected to further rolling so as to obtain a product of desired shape, or be subjected to a required heat treatment.

The method in accordance with this invention for forming an amorphous powder into a formed body wherein a metal tube filled with the amorphous powder is subjected to rolling at a property-preserving temperature will be described.

Figure 2:
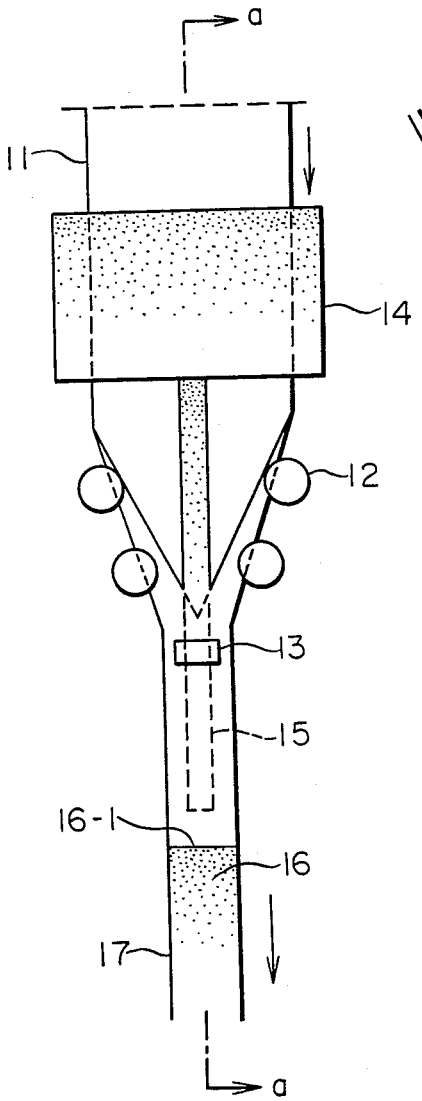
FIG. 2 is a side view showing a forming step, a welding step and a charging step for a metal pipe containing amorphous material therein.
Figure 3:
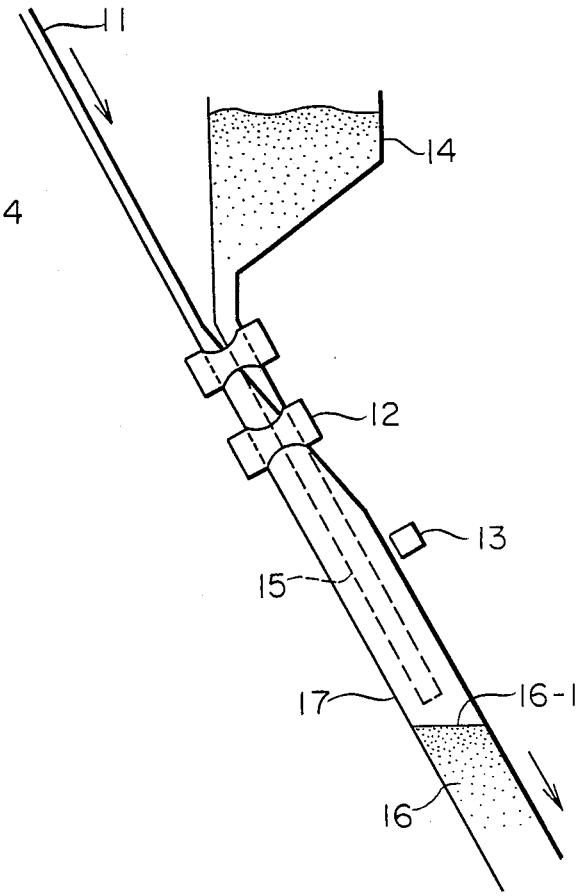
FIG. 3 is a sectional view taken along a-a of FIG. 2.

FIG. 2 shows a forming step, welding step, and charging step used in an embodiment of the invention and FIG. 3 shows a sectional view taken along line a-a in FIG. 2. Reference numeral 11 denotes a metal band which is formed into a tubular body by forming rolls 12. The metal band 11 is sufficiently strong for use in the rolling process of the invention. It is formed of, for instance, an austenitic stainless steel, which has high strength. The opposed edges of the metal band formed into a tubular body are welded by a welder 13 to produce a closed tube.

Of the various welding methods, electron beam welding is particularly preferred since it has little effect on the parent metal and provides a good weld. In case the metal band is of austenitic stainless steel and electron beam welding is applied, no heat treatment is required after the welding since there is no reduction of toughness. When necessary, a heat treatment suited to the particular weld zone is carried out. In the drawing, reference numeral 14 denotes an amorphous powder tank 14 provided with a feed pipe 15 for feeding amorphous powder 16 from a position upstream of the weld zone to a position downstream of the weld zone where it is charged into a welded metal tube 17 formed from the band 11. This charging method is preferred because it protects the amorphous powder 16 from being affected by the heat of the welder 13.

The amorphous powder 16 is uniformly charged into the metal tube over its full length by, for instance. controlling the rate at which the amorphous powder is fed from the tank 14 and the powder level 16-1 within the metal tube. The level 16-1 of the amorphous powder can be detected by, for instance, a gamma ray sensor from the outside of the metal tube 15. Further, where a high charging density is desired, this can be realized by vibrating the metal tube from the outside, if necessary, with a rod giving a compressive force to the powders.

The invention comprises the steps of charging an amorphous powder into a metal tube having a great wall thickness and high strength, and subjecting the metal tube together with the powder therein to a rolling as illustrated in FIG. 1. At this time, the metal tube 15 undergoes plastic deformation and the powder within the metal tube undergoes the extension and elongation. The resistance of the metal tube 15 to deformation is much greater than that of the material, and further, the metal tube has high strength and ductility. Therefore in the rolling process, a heavy rolling reduction force is required, with the result that densification of the amorphous powder contained in the tube is facilitated.

The rolling process is carried out at a temperature at which the excellent properties of the material are maintained. For instance, in the case of a powder produced from an alloy foil of amorphous $Fe_{79}Si_8B_{13}$ (Fe: 79, Si: 8, B: 13 by atomic %), it is a temperature not higher than 520° C., the temperature of the onset of crystallization. When the rolling is conducted at a temperature lower than the property-preserving temperature, the so-formed product maintains the physical and chemical properties of the amorphous material. Even if the forming temperature should exceed the temperature of the onset of crystallization, the physical and chemical properties will not be impaired so long as the higher temperature continues only for a very short time.

The amorphous powder used in the invention is an alloy of metal and semi-metal or an alloy of metal and metal, and is produced, for example, by the rapid quenching or mechanical alloying method. In the alloy of metal and semi-metal, the metal may, for instance, be one or more of Fe, Co, Ni, Cr, Mo, V, Nb, Zr and Ti, while the semi-metal is one or more of B, Si, C, P, and Ge. The alloy of metal and metal may be a combination of metals such as Fe-Ti, Fe-Zr, and Cu-Ti.

Various rapid quenching methods for directly producing amorphous powder are available, such as the atomizing method, cavitation method, molten metal spraying method, plasma melt spraying method, etc. Amorphous powder can also be obtained by mechanical alloying, or by pulverizing a rapid quenched sheet or fine wire with a ball mill.

In this invention, the metal tube is filled with the amorphous powder. Since the metal tube is a cylindrical container, the charging density of the amorphous powder can be considerably increased by carrying out pre-compression.

Figure 4:
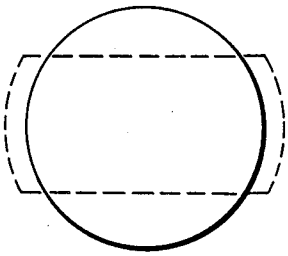
FIGS. 4(A) and 4(B) are views for explaining the compression effect of the present invention.
Figure 4:
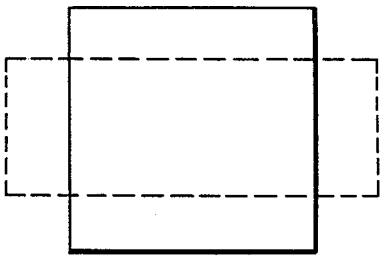

Two conceivable modes of pre-compression are shown in FIG. 4. FIG. 4-(A) shows a case in which a metal tube with a cross section as indicated by the solid line circle was compressed to one-half of its height with no change in circumferential length, as shown by the broken line. The cross-sectional area of the flattened tube is about 68% of the original circular area, meaning that the compression results in a decrease in area of about 32%.

FIG. 4-(B) shows a case in which a metal tube with a cross section as shown by the solid line square was compressed to one-half of its height with no change in the length of the perimeter, as shown by the dotted line rectangle. The area of the rectangle is 75% of the area of the original square, meaning that the compression results in a decrease in area of only 25%.

In the present invention, the mode of precompression shown in FIG. 4-(A) is used. Thus, the increase in charging density (equivalent to the decrease in sectional area) within the tubular container is greater than that in the case of a container with a square cross section. Accordingly, the metal container of the invention is much more suited for increasing the charging density of the amorphous powder by pre-compression than containers of other sectional shapes.

Since the metal container of the invention is of a circular section and has no corners, the amorphous powder is charged therein at a uniform density. Further, since the densifying compression is carried out by rolling, it can be conducted more efficiently by use of a long metal container. The use of a long metal container also enables the rolling for forming a shaped product from the amorphous powder to be carried to with high efficiency and at a high yield.

While this invention can be carried out with the sealed metal container evacuated prior to rolling, it is alternatively possible to deal with any air contained in the metal container or with any inert gas contained therein (such as inert gas introduced by fabrication of the metal container under an inert gas atmosphere), by providing one or more gas vent holes therein and sealing both ends of the container at the time of the densifying compression. In this case, substantially all of the gas will escape to the exterior through the vent holes.

Another embodiment of the method for producing a formed product from amorphous powder will now be described.

A metal tube of sufficient strength to endure the forming step is filled with an amorphous powder. As described hereinbefore, the metal tube and the amorphous powder contained therein are together subjected to rolling. During rolling, the rolling pressure plastically deforms the metal tube and the powder therein. The resistance of the metal tube to deformation is greater than that of the powder contained therein. While the metal tube has a large wall thickness and a high strength, it also has ductility. Therefore the rolling process requires a great rolling reduction pressure, which results in densification of the amorphous powder contained in the tube.

The metal tube used in this invention, for example, has a ratio of length L to diameter D of at least 10 to 1. (When the metal tube is of ring-like section, D is taken as inside diameter and when it has a polygonal section, D is taken as the diameter of an inscribed circle).

As described hereinbefore, the amorphous powder is restricted by the metal tube and forcibly bitten by the rolls. During biting, a repulsive force to push back the powder arises, and it is necessary for the metal tube to have a sufficient length to restrict the fluidity of the material against this repulling force.

In other words, if the ratio L/D is too small, the powder may be pushed back before being bit by the rolls, but if a metal tube wherein L/D is equal to 10 or more is used, no repulsion arises. Thus, the powder is subjected to a great rolling force.

In the rolling process, for preventing the powder from escaping from the metal tube, the ends of the metal tube may be closed by a fragile material such as cork, wood, etc. Alternatively, the ends of the tubes may be opened.

The charging density of the amorphous powder can be increased by conducting the pre-compression mentioned earlier. The metal tube into which the amorphous powder is charged is rolled in the manner illustrated in FIG. 1 at a temperature which ensures preservation of the characteristic properties of the powder.

As fully described in the foregoing, in accordance with the invention, it is possible to form a non-equilibrium and/or metastable material into a solid formed product by a simple method. The present invention can be applied to powders, foils or fine wires of such various materials as elemental metals, alloys, glass and ceramics, either individually or in mixtures, and, by appropriate selection of the material, the size of the metal tube, and the rolling conditions can produce a solid formed body of any desired size.

EXAMPLE 1

There was used an alloy powder (average particle size, 150 μm) produced by the water atomizing method and consisting by weight of 90% Al and 10% Fe. The metal container was a tube of SUS304 (inside diameter, 20 mm; outside diameter, 35 mm; and length, 150 mm) having its ends processed as illustrated in FIG. 1. The metal container was filled with 50 g of the above powder and was sealed in an argon atmosphere. The metal container with the powder therein was reduced in thickness to about 15 mm by a pressing, and was thereafter rolled by a rolling mill having 300 mm rolls at about 0.1 m/s. It was reduced 15 mm to 11 mm in a first pass, and from 11 mm to 8 mm in a second pass. The rolling was conducted at ambient temperature, 200° C., and 300° C., respectively. The density of the formed product obtained by rolling at ambient temperature was about 95%, while those of the formed products obtained at 200° C. and 300+ C. were nearly 100%. A tensile test conducted on the formed products showed that the sample obtained by rolling at 300° C. had a strength of about 450 MPa and an elongation of about 10%.

EXAMPLE 2

Band foil (50 mm wide, 30 μm thick) of a commercially available amorphous alloy (2826 MB) was tightly coiled into a cylindrical shape and charged into a SUS304 tube (inner diameter, 20 mm; outer diameter, 35 mm), both ends of which were sealed in an argon atmosphere. The tube was reduced in thickness to 15 mm, immersed in an oil bath maintained at 405° C. for two minutes, and immediately rolled in a single pass to a thickness of 9 mm. After rolling, the sample was immediately plunged into water to rapidly cool it. After cooling, the stainless steel container was removed to recover the amorphous sample. It was found by X-ray diffraction that the sample maintained its amorphous state. Further, it was found that the original band folds of the sample were so thoughly adhered together that the boundaries therebetween could hardly be discerned. The thus obtained amorphous formed article was about 3 mm thick and about 50 mm wide. When the above process was repeated using a pulverized band foil as the amorphous material, similar results were obtained.

EXAMPLE 3

A 5 mm thick, 5 m long steel band of SUS304 was formed by rolling into a tubular body having an outer diameter 35 mm and an inner diameter 25 mm, and the opposed edges thereof were electron beam welded in the manner shown in FIG. 2. During forming of the tube, a powder obtained by pulverizing band foil of amorphous alloy ($Fe_{79}Si_8B_{13}$) was passed from upstream of the weld zone via a feeding pipe to a point downstream of the weld zone for charging into a stainless steel tube filled with argon gas. Thus there was obtained a 5 m long stainless steel tube charged with the amorphous powder. Both ends of the stainless steel tube were sealed but were provided with small gas vent holes. The thickness of the tube was reduced to 20 mm by rolling for the purpose of densification. Thereafter it was immersed in a 510° C. salt bath for two minutes, and was thereafter immediately rolled to a thickness of 11 mm in a single pass. The rolling was carried out using a rolling mill with 300 mm rolls at a rolling speed of about 0.1 m/s. After passing through the roll, the rolled tube was instantly water cooled. After cooling, the stainless steel tube was removed to recover an amorphous solid formed product about 3.5 mm thick and about 35 mm wide. The solid formed product was found by X-ray diffraction to maintain its amorphous state.

EXAMPLE 4

A tube of SUS304 with an outer diameter of 35 mm, an inner diameter of 25 mm and 5 m in length was charged fully with a powder obtained by the pulverizing band foil of amorphous alloy ($Fe_{79}Si_8B_{13}$). There was thus obtained a 5 m stainless steel tube filled with amorphous powder. The ends of the stainless steel tube were not sealed. For pre-compression, the thickness of the tube was reduced to 20 mm by rolling. Thereafter the opposite ends of the tube were supported on L-shaped supports, and the tube was immersed in a 510° C. salt bath for two minutes. The support members were removed and the tube was immediately rolled a thickness 11 mm in a single pass. The rolling step was conducted using a rolling mill with 300 mm rolls at a rolling speed of about 0.1 m/s. After rolling, the tube was immediately water cooled. After cooling, the stainless steel tube was removed to recover an amorphous solid formed product of about 3.5 mm thick and about 35 mm wide.

The solid formed product was found by X-ray diffraction to maintain its amorphous state.

We claim:

1. In a method for forming a non-equilibrium and/or metastable metallic or non-metallic powder, foil or fine wire material into a solid shaped product which comprises charging said material into a metal container of sufficient strength to resist a rolling step;

heating said metal container containing said powder, foil, or fine wire materials;

subjecting said container containing said powder, foil, or fine wire material to a forced rolling step whereby a solid shaped product is formed; and cooling said product; the improvement which comprises carrying out said heating by rapidly heating said metal container together with said powder, foil, or fine wire material to a property preserving temperature, and rapidly cooling the obtained solid shaped product.

2. The method as claimed in claim 1 in which vacuum or an inert gas atmosphere is maintained within said metal container.

3. The method as claimed in claim 1 or 2 in which a hot bath is applied to heat said metal container together with said material charged into said metal container, and said material together with said container are water cooled after said rolling step.

4. The method as claimed in any one of claims 1–3 in which said powder, foil or fine wire material is an amorphous alloy, and said property preserving temperature is less than the temperature where the onset of crystallization of said alloy occurs.

5. The method as claimed in any one of claims 1–3 in which said powder, foil or fine wire material to be formed is a super-rapidly quenched alloy of A1-Fe, and said property preserving temperature is specified to be less than about 350° C.

6. The method as claimed in claim 1 in which said powder, foil or fine wire material of a non-equilibrium/-metastable metal is charged into a metal container of sufficient strength to resist a forming step in which a ratio of L/D, where L being length and D inside diameter of said metal container, is more than 10, and said metal container is subjected to rolling without sealing at a property preserving temperature.

7. The method as claimed in claim 1 in which said non-equilibrium/metatasable metal powder is formed into a plate-like solid product and wherein a metal bond is formed into a tubular body and the opposing edges thereof are welded to form said metal containers.

* * * * *